US006203352B1

(12) United States Patent
Murakami et al.

(10) Patent No.: US 6,203,352 B1
(45) Date of Patent: Mar. 20, 2001

(54) CONNECTOR HAVING A SHIELDING MEMBER

(75) Inventors: Takao Murakami; Shogo Suzuki, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/326,697

(22) Filed: Jun. 7, 1999

(30) Foreign Application Priority Data

Jun. 8, 1998 (JP) ..... 10-159440

(51) Int. Cl.[7] ..... H01R 13/627
(52) U.S. Cl. ..... 439/352; 439/354
(58) Field of Search ..... 439/610, 607, 439/608, 609, 352, 354, 344

(56) References Cited

U.S. PATENT DOCUMENTS 4,810,210 * 3/1989 Komatsu ..... 439/610
5,435,744 * 7/1995 Derstine et al. ..... 439/352

FOREIGN PATENT DOCUMENTS 4-69878 6/1992 (JP) ..... H01R/13/648

* cited by examiner

*Primary Examiner*—Lincoln Donovan
*Assistant Examiner*—Chandrika Prasad
(74) *Attorney, Agent, or Firm*—Sughrue, Mion, Zinn, Macpeak & Seas, PLLC

(57) ABSTRACT

In a connector having a shielding member, a groove portion is provided on an inner side of a metal shell shieldingly connected to a shielded wire of a female connector, and a shrunk tube is provided on an outer side of the metal shell. A male connector has a shielding member shieldingly connected to a shielded wire, an engaging projection for engagement with the groove portion and provided at an intermediate portion of a resilient piece extending to outside a male housing for holding a male-type terminal, and a disengaging piece provided in a rear end portion of the resilient piece. Further, a second unlocking portion for covering the disengaging piece and pressing the disengaging piece toward an axial side is provided in a rear end portion of the male housing.

4 Claims, 7 Drawing Sheets

CONNECTOR HAVING A SHIELDING MEMBER

BACKGROUND OF THE INVENTION

1. Field of the Invention

The present invention relates to a connector having a shielding member for connecting a shielded wire used for electrical connection of audio equipment mounted in an automobile or the like.

2. Description of the Related Art

Conventionally, concerning connectors having a shielding member for connecting a shielded wire, various connectors are known as disclosed in Japanese Utility Model Unexamined Publication No. Hei. 4-69878. For example, a connector 81 having a shielding member shown in FIGS. 7 and 8 is arranged such that a plug-type male connector 82 is engaged with and connected to a socket-type female connector 83.

As shown in FIG. 7, notched portions 85 for engagement with the mating female connector 83 are provided at central portions of a peripheral wall of a male housing 84 of the male connector 82. In addition, a shielded wire W is held on the inner side of a rear end portion of the male housing 84. A sheathing portion of the shielded wire W in the male housing 84 is stripped off, and cores 86 and a shielding braid S on the outer side thereof are exposed.

As shown in FIG. 8, the shielding braid S toward its tip is spread out in an internal shape of the male housing 84, e.g., a square cross section, and a shielding-braid connecting member 87 of a square cross section, which is formed of a metal plate and serves as the shielding member, is soldered to its tip.

Incidentally, this shielding-braid connecting member 87 is provided in such a manner as to cover the notched portions 85 in contact therewith, and the cores 86 are connected to female-type terminals 88 embedded in a tip portion of the male housing 84.

In addition, male-type terminals 90, which are connected to the female-type terminals 88, are provided projectingly on a rear-end bottom wall of a socket-type female housing 89 of the female connector 83, and rear-surface terminals 91 project from a rear-end surface of the bottom wall and are adapted to be connected to an equipment body (not shown) via electric wires.

As shown in FIG. 7, two leaf springs 92 are embedded in the female housing 89. In each leaf spring 92, a jutting-out portion 93 projects on the outer side of the female housing 89, and a leaf-spring projecting portion 94 is provided on the inner side of the female housing 89. Further, an introducing portion 95 for the male housing 84 is formed at a tip portion of each leaf spring 92 in such a manner as to project outwardly from the tip of the female housing 89.

Incidentally, since a flange portion 96 of the female housing 89 is fitted in a female-connector attaching hole provided in a casing which also serves as a shield for the equipment body, the male-type terminals 90 are inserted in a shielding area, so that nonshielded general electric wires are connected to the rear-surface terminals 91.

In the connector 81 having a shielding member constructed as described above, the female connector 83 is first fitted in the attaching hole of the equipment body by means of the flange portion 96. Then, since the jutting-out portions 93 of the leaf springs 92 come into contact with the casing which also serves as a shield for the equipment body, the leaf springs 92 function as shielding members.

In addition, when the male connector 82 is fitted into the female connector 83, the introducing portions 95 and the leaf-spring projecting portions 94 of the leaf springs 92 are spread out, and the male-type terminals 90 are engaged in and connected to the female-type terminals 88. Then, the leaf-spring projecting portions 94 are engaged in the notched portions 85 from the outer sides thereof, thereby retaining the male housing 84. At this time, since the shielding-braid connecting member 87 is pressed against and held in contact with the tips of the leaf-spring projecting portions 94, the shielding braid S is reliably shielded.

However, with the conventional connector 81 having a shielding member constructed as described above, since the male and female housings 84 and 89 must be pulled apart while pulling the two introducing portions 95 of the leaf springs 92 so as to cancel the connection, there has been a problem that the operating efficiency at the time of disconnection is poor.

In addition, since the introducing portions 95 are exposed to the outside even after the engagement and connection of the male and female connectors 82 and 83, there is a risk of shortcircuiting and there is a possibility of disengagement due to a collision by an external object. Hence, there have been problems in terms of safety and reliability.

SUMMARY OF THE INVENTION

Accordingly, it is an object of the present invention to provide a connector having a shielding member which facilitates the operation of disengaging male and female connectors, and in which the shielding member and conductive members are not exposed to the outside, thereby overcoming the above-described drawbacks of the conventional connector.

In order to achieve the above object, according to an aspect of the present invention, there is provided a connector having a shielding member including a male connector and a female connector which are respectively connected to shielded wires, and respectively provided with a female-type terminal and a male-type terminal, a shielding member being provided on at least one of the male and female connectors, comprising: a disengaging mechanism in which a groove portion is provided on an inner side of a female connector-side metal shell shieldingly connected to the shielded wire of the female connector, a resilient piece serving as a shielding member extending to an outside rearwardly from a front end portion of a male housing for holding the male-type terminal is provided in the shielding member shieldingly connected to the shielded wire of the male connector, and the resilient piece has an engaging projection for engaging in the groove portion, the disengaging mechanism being adapted to cancel a state of engagement of the engaging projection in the groove portion as the engaging projection is moved toward an axial side, wherein the disengaging mechanism has a sliding member provided on an outer periphery of the male housing and capable of sliding in an axial direction, and a pressing wall disposed at a rear portion of the sliding member so as to press a disengaging piece toward the axial side.

With the connector having a shielding member according to the above-described aspect of the present invention, to cancel the state of engagement between the male and female connectors, it is sufficient to merely pull apart the male connector from the female connector while holding the sliding member, so that it is possible to improve the efficiency in the unlocking operation.

In addition, since the displacement of the disengaging piece becomes large, even if the dimensional accuracy of the resilient piece drops slightly, the effect on the operation is small, so that the manufacture is facilitated.

Further, since the disengaging piece is not exposed to the outside, there is no risk of shortcircuiting and malfunctioning due to a collision by an external object. Accordingly, it is possible to obtain a highly reliable connector having a shielding member in which the efficiency in the engaging and disengaging operations is improved.

According to another aspect of the present invention, there is provided a connector having a shielding member including a male connector and a female connector which are respectively connected to shielded wires, and respectively provided with a female-type terminal and a male-type terminal, a shielding member being provided on at least one of the male and female connectors, comprising: a disengaging mechanism in which a groove portion is provided on an inner side of a female connector-side metal shell shieldingly connected to the shielded wire of the female connector, a resilient piece serving as a shielding member extending to an outside rearwardly from a front end portion of a male housing for holding the male-type terminal is provided in the shielding member shieldingly connected to the shielded wire of the male connector, and the resilient piece has an engaging projection for engaging in the groove portion, the disengaging mechanism being adapted to cancel a state of engagement of the engaging projection in the groove portion as the engaging projection is moved toward an axial side, wherein the disengaging mechanism is arranged such that the engaging projection at an intermediate portion of the resilient piece and a disengaging piece at a rear end portion extending therefrom are provided in a continuous manner, and a flexible unlocking portion, which covers the disengaging piece and is capable of pressing the disengaging piece toward the axial side, is provided at a rear end portion of the male housing.

With the connector having a shielding member according to the above-described aspect of the invention, since the disengaging mechanism is arranged such that the engaging projection at the intermediate portion of the resilient piece and the disengaging piece at the rear end portion extending therefrom are provided in a continuous manner, the pressing force against the disengaging piece at the time of disengaging the engaging projection from the groove portion can be small, thereby facilitating the unlocking operation.

In addition, since the displacement of the disengaging piece becomes large, even if the dimensional accuracy of the resilient piece drops slightly, the effect on the operation is small, so that the manufacture is facilitated.

Further, since the flexible second unlocking portion, which covers the disengaging piece and is capable of pressing the disengaging piece toward the axial side, is provided at the rear end portion of the male housing, an additional part such as the sliding member becomes unnecessary, so that the number of parts used can be reduced. Additionally, to disengage the male and female connectors, it suffices to pull apart the male housing from the female connector while pressing the second unlocking portion, so that the unlocking operation is further facilitated.

Furthermore, since the disengaging piece is not exposed to the outside, there is no risk of shortcircuiting and malfunctioning due to a collision by an external object. Accordingly, it is possible to obtain a highly reliable connector having a shielding member which makes it possible to reduce the cost and in which the efficiency in the engaging and disengaging operations is improved.

DETAILED DESCRIPTION OF THE PREFERRED EMBODIMENTS

Figure 1:
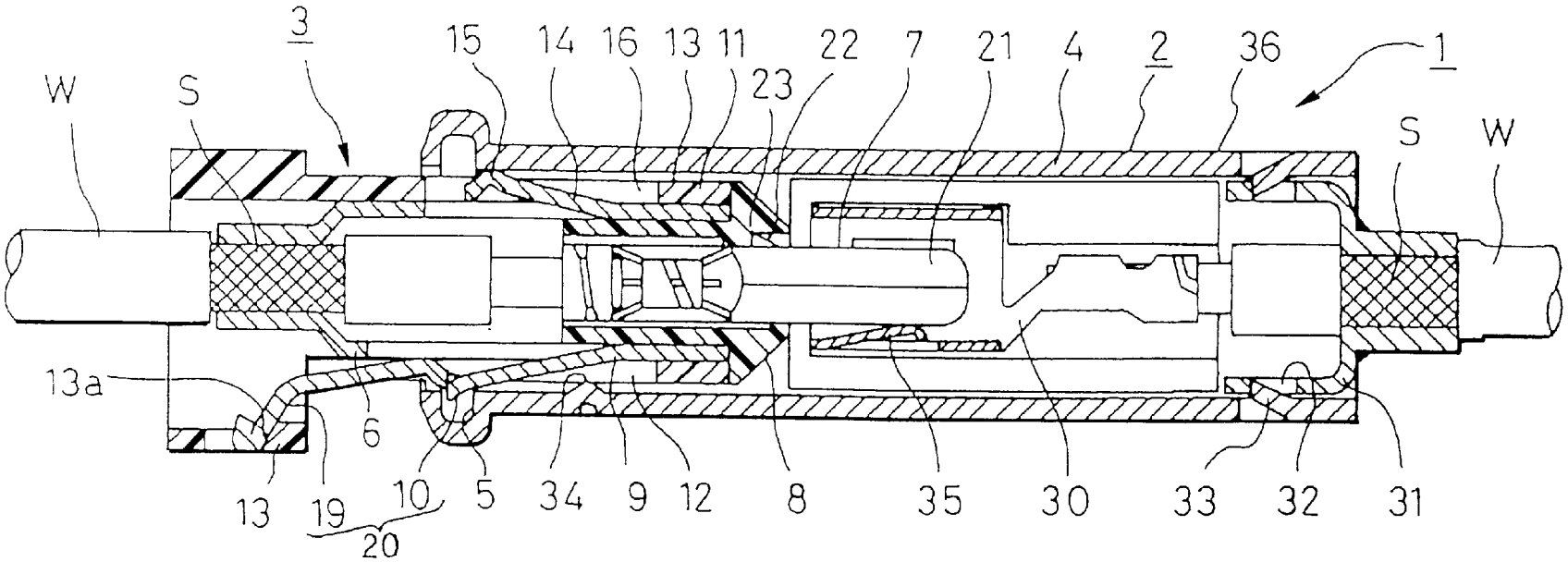
FIG. 1 is a longitudinal cross-sectional view illustrating a first embodiment of a connector having a shielding member according to the present invention.
Figure 2:
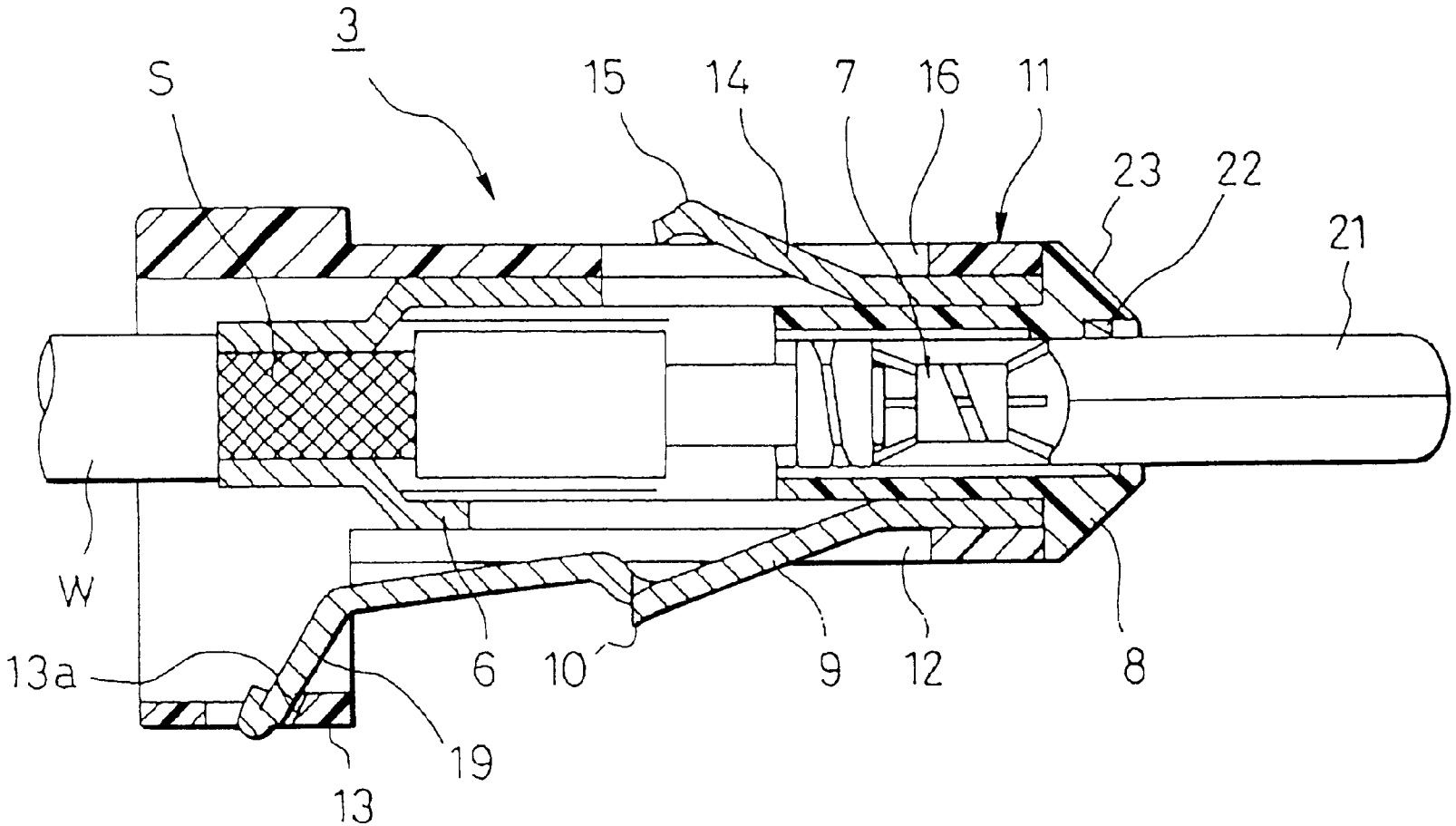
FIG. 2 is a longitudinal cross-sectional view of a male connector in FIG. 1.
Figure 3:
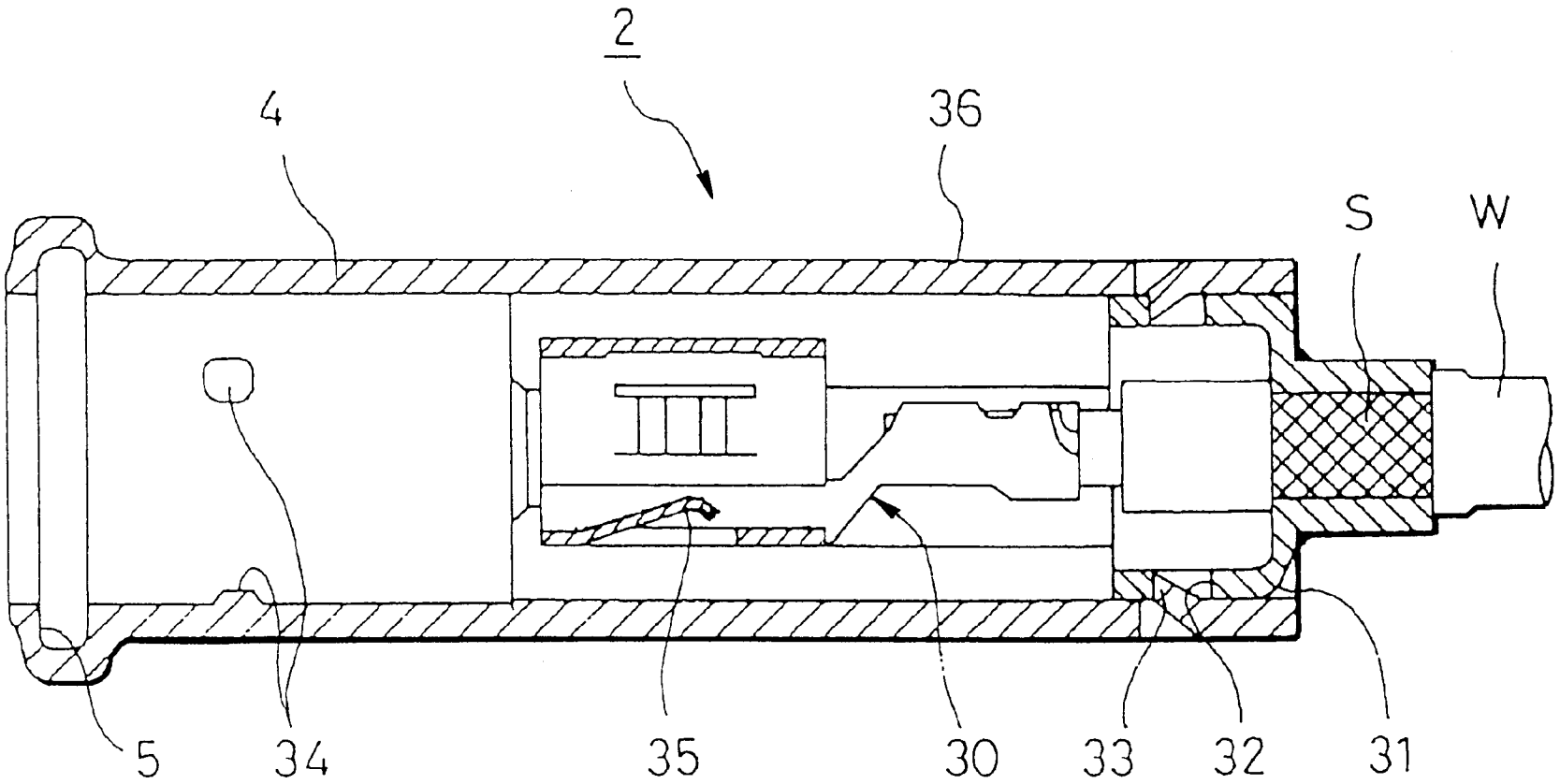
FIG. 3 is a longitudinal cross-sectional view of a female connector in FIG. 1.
Figure 4:
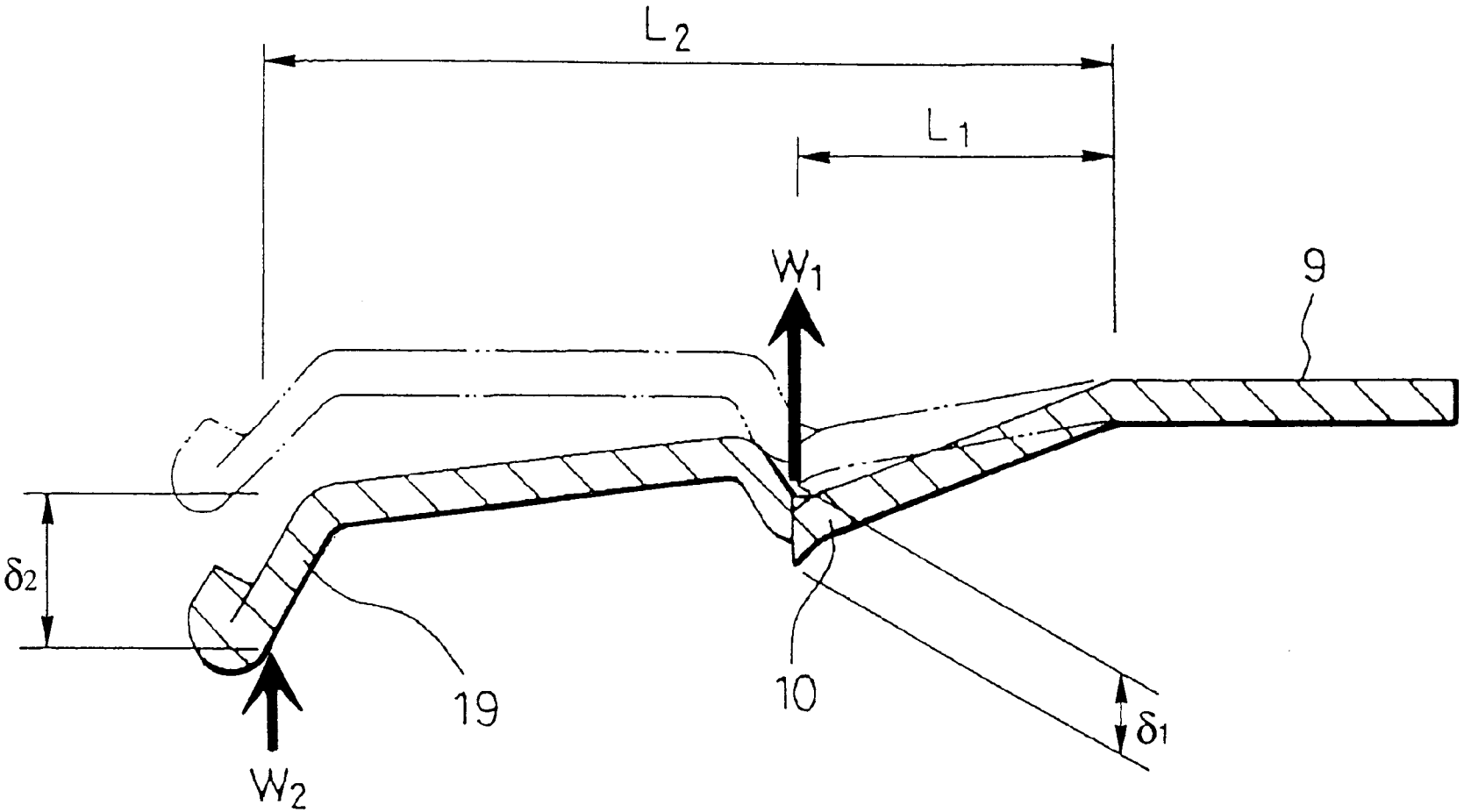
FIG. 4 is a diagram illustrating the operation of a resilient piece in FIG. 1.
Figure 5:
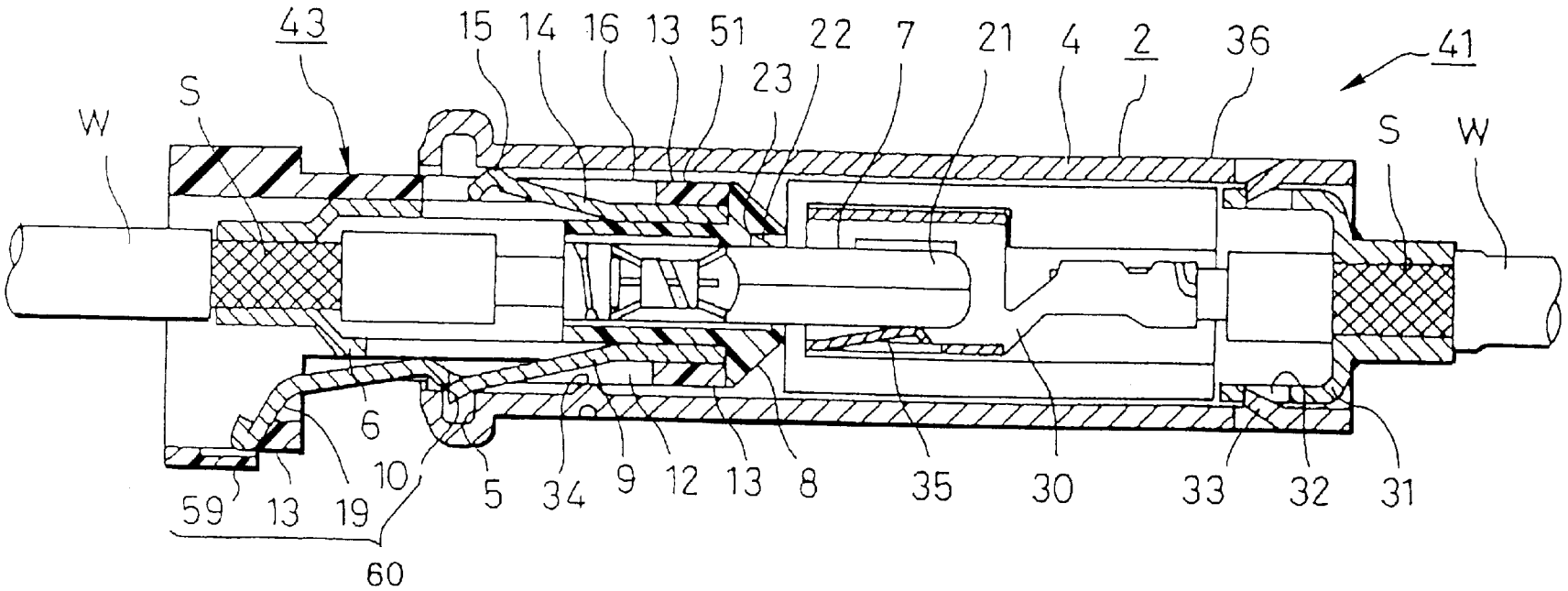
FIG. 5 is a longitudinal cross-sectional view illustrating a second embodiment of the connector having a shielding member according to the present invention.
Figure 6:
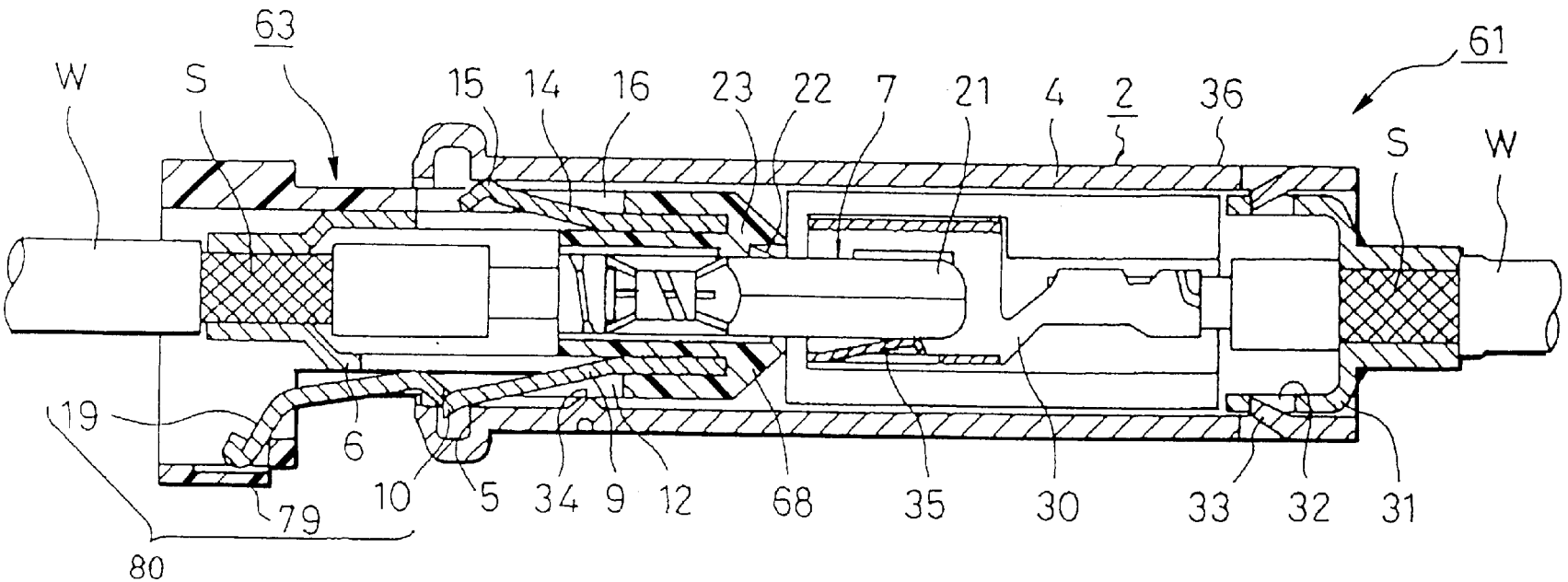
FIG. 6 is a longitudinal cross-sectional view illustrating a third embodiment of the connector having a shielding member according to the present invention.
Figure 7:
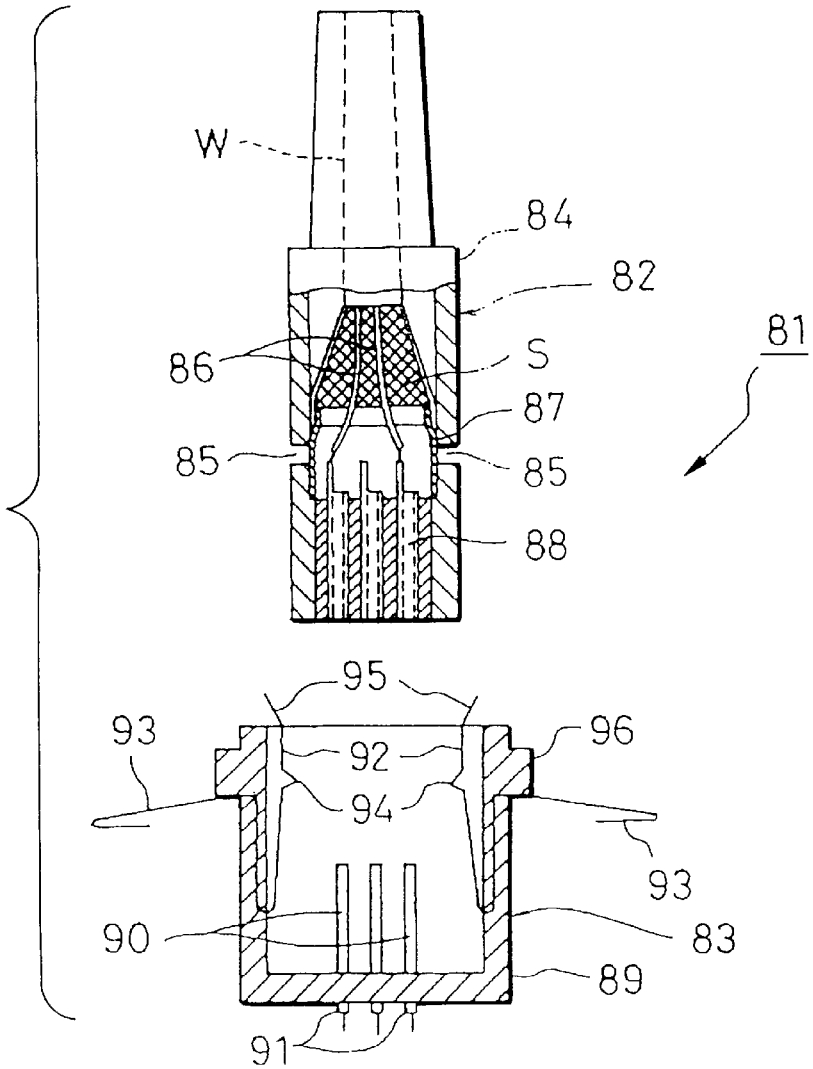
FIG. 7 PRIOR ART
FIG. 7 is a longitudinal cross-sectional view illustrating an example of a conventional connector having a shielding member.
Figure 8:
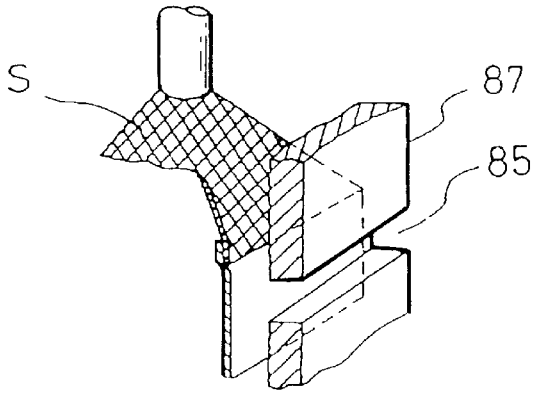
FIG. 8 PRIOR ART
FIG. 8 is a partial perspective view illustrating an essential portion in FIG. 7.

Referring now to FIGS. 1 to 6, a detailed description will be given of a connector having a shielding member according to the present invention. FIG. 1 is a longitudinal cross-sectional view illustrating a first embodiment of the connector having a shielding member according to the present invention; FIG. 2 is a longitudinal cross-sectional view of a male connector in FIG. 1; FIG. 3 is a longitudinal cross-sectional view of a female connector in FIG. 1; FIG. 4 is a diagram illustrating the operation of a resilient piece in FIG. 1; FIG. 5 is a longitudinal cross-sectional view illustrating a second embodiment of the connector having a shielding member according to the present invention; and FIG. 6 is a longitudinal cross-sectional view illustrating a third embodiment of the connector having a shielding member according to the present invention.

As shown in FIGS. 1 to 4, a connector 1 having a shielding member according to the first embodiment is comprised of a female connector 2 and a male connector 3 for connecting two shielded wires W, and a groove portion 5 is provided on the inner side of a substantially tubular metal shell 4 shieldingly connected to a shielding braid S of the shielded wire W of the female connector 2. Meanwhile, a male housing 8 for holding a male-type terminal 7 and formed of a nonconductive material such as a synthetic resin is fitted in a shielding-braid connecting member 6 formed of a conductive material such as a metal and serving as a shielding member shieldingly connected to the shielding braid S of the shielded wire W of the male connector 3.

This shielding-braid connecting member 6 is provided with an appropriate number of resilient pieces 9 (only one is provided in FIG. 1) extending on an outer peripheral portion of the male housing 8. The resilient piece 9 has an engaging projection 10 for engaging in the groove portion 5. Further, the resilient piece 9 has a disengaging mechanism 20 for canceling the engagement of the engaging projection 10 with the groove portion 5 by moving the engaging projection 10 toward the axial side. In the disengaging mechanism 20, the engaging projection 10 at an intermediate portion of the resilient piece 9 and a disengaging piece 19 at a rear end portion extending therefrom are provided in a continuous manner.

A sliding member 11, which is capable of sliding in the axial direction and formed of a nonconductive material such as a synthetic resin, is provided on the outer periphery of the shielding-braid connecting member 6. A notched portion 12, through which the engaging projection 10 is capable of projecting, is provided in the sliding member 11. Further, a pressing wall 13 having an inclined surface 13*a* capable of pressing the engaging projection 10 together with the disengaging piece 19 and the resilient piece 9 toward the axial side is formed in a wall portion of the sliding member 11 in the rear of the notched portion 12.

Namely, in addition to the resilient piece 9 provided with the engaging projection 10, the shielding-braid connecting member 6 is provided with a resilient piece 14 having at its tip a contact 15 for being electrically connected by coming into contact with an inner wall of the metal shell 4 of the female connector 2, the resilient piece 14 being provided in such a manner as to oppose the resilient piece 9. Accordingly, the sliding member 11 is provided with a notched portion 16 through which the resilient piece 14 with the contact 15 is capable of projecting.

In addition, a retaining lance 22 is provided on an outer surface of a connecting portion 21 provided at a distal end portion of the male-type terminal 7, and is adapted to retain a stepped portion 23 provided on an inner wall of a tip portion of the male housing 8.

Next, as shown in FIG. 3, the female connector 2 is provided with a plurality of guide projections 34 for guiding the sliding member 11 of the male connector 3 to the inner wall of the tip portion of the metal shell 4. Further, provided on the inner wall of a rear end portion of the metal shell 4 are retaining lances 33 in such a manner as to be oriented diagonally forward so as to be retained in retaining holes 32 in a shielding-braid connecting portion 31 which is shieldingly connected to the shielding braid S of the shielded wire W on the side of the female connector 2. Furthermore, a spring contact 35 for reliably establishing electrical contact with the connecting portion 21 of the male-type terminal 7 is provided in a female-type terminal 30. Additionally, a shrunk tube 36 formed of a nonconductive material is covered around the outer periphery of the female connector 2.

In the connector 1 having a shielding member constructed as described above, as shown in FIG. 1, the male and female connectors 3 and 2 can be easily connected together if they are pressed with their distal ends aligned with each other. Namely, the male- and female-type terminals 7 and 30 are electrically connected by the spring contact 35, and the outer side is covered with components which are shieldingly connected to the male- and female-side shielding braids S. Accordingly, the male and female connectors 3 and 2 are shieldingly connected in the order of the male-side shielding braid S, the shielding-braid connecting member 6, the resilient piece 14, the contact 15, the metal shell 4, the retaining lance 33, the shielding-braid connecting member 31, and the female-side shielding braid S.

In addition, since the engaging projections 10 pressed toward the outer side are inserted in the groove portion 5 by means of the resilient pieces 9, the male and female connectors 3 and 2 are connected together easily and reliably, and it is possible to improve the operating efficiency in fitting and the reliability of the connector.

Next, in a case where the engaged state of the connected male and female connectors 3 and 2 is canceled, the metal shell 4 covered with the shrunk tube 36 of the female connector 2 and the sliding member 11 of the male connector 3 are pulled in the disengaging direction, as shown in FIGS. 1 and 2. Then, since the sliding member 11 slides in the disengaging direction, the resilient pieces 9 and 14 are bent toward the axial direction by means of the inclined surface 13*a* of the pressing wall 13 and the inclined surfaces of the disengaging piece 19 and the contact 15. Accordingly, the engaging projection 10 comes off the groove portion 5, and the contact 15 is separated from the inner surface of the metal shell 4.

Then, when the sliding member 11 is pulled in the disengaging direction, the shielding-braid connecting member 6 is also pulled in the disengaging direction by means of a stopper (not shown) disposed between the sliding member 11 and the shielding-braid connecting member 6. Then, since the stepped portion 23 is ceased to be abutted against by the retaining lance 22 of the connecting portion 21, the male-type terminal 7 is disengaged from the female-type terminal 30. Accordingly, the connection between the male and female connectors 3 and 2 can be easily canceled by merely pulling apart the metal shell 4, i.e., an outer shell for the male and female connectors 3 and 2, and the shielding-braid connecting member 6 in the disengaging direction, thereby making it possible to improve the efficiency in the disengaging operation.

According to the connector 1 having a shielding member in the above-described embodiment, since the engaging projection 10 at the intermediate portion of the resilient piece 9 and the disengaging piece 19 at the rear end portion extending therefrom are provided in a continuous manner, the distances L1 and L2 of the engaging projection 10 and the disengaging piece 19 from the fulcrum of deflection are constantly in the relationship of $L1<L2$, as shown in FIG. 4. Accordingly, since the pressing force W2 applied to the disengaging piece 19 at the time of disengaging the engaging projection 10 from the groove portion 5 can be small, the unlocking operation can be effected easily.

On the other hand, since the displacement $\delta 2$ of the disengaging piece 19 is greater than the displacement $\delta 1$ the engaging projection 10, even if the dimensional accuracy of the resilient piece 9 drops slightly, the effect on the operation is small, so that the manufacture is facilitated. In addition, to cancel the state of engagement between the male and female connectors 3 and 2, it is sufficient to merely pull apart the male connector 3 from the female connector 2 while holding the sliding member 11, so that it is possible to improve the efficiency in the disengaging operation.

Next, referring to FIG. 5, a description will be given of a second embodiment of the connector having a shielding member according to the present invention. It should be noted that portions having the same configurations as those of the above-described embodiment will be designated by the same reference numerals, and a detailed description thereof will be omitted.

As shown in FIG. 5, in a connector 41 having a shielding member in this embodiment, a flexible first unlocking portion 59 is added to the disengaging mechanism 20 in the above-described first embodiment so as to constitute a disengaging mechanism 60. Namely, this disengaging mechanism 60 is arranged such that, in addition to the pressing wall 13, the flexible first unlocking portion 59, which covers the disengaging piece 19 and is capable of pressing the disengaging piece 19 toward the axial side, is provided in a rear end portion of a sliding member 51.

According to the connector 41 having a shielding member constructed as described above, when the engagement between the male and female connectors is canceled, a male connector 43 may be merely pulled apart from the female connector 2 while holding the sliding member 51, but may be pulled apart while pressing the first unlocking portion 59. In this case, since the frictional force due to the inclined surface 13*a* of the pressing wall 13 is not present, the pulling-apart force can be smaller. Accordingly, since there are two ways of the disengaging operation, which can be selected depending on the situation at the time of maintenance, the features of the product can be improved, and the efficiency in the disengaging operation can be further improved.

Next, referring to FIG. 6, a description will be given of a third embodiment of the connector having a shielding member according to the present invention. It should be noted that portions having the same configurations as those of the above-described embodiments will be designated by the same reference numerals, and a detailed description thereof will be omitted.

As shown in FIG. 6, in a connector 61 having a shielding member in this embodiment, the disengaging mechanism 20 in the above-described first embodiment is not provided with the sliding member 11 and the pressing wall 13, but a male housing having a flexible second unlocking portion 79, which is formed by extending the male housing 8 to the rear, covers at its rear end portion the disengaging piece 19 and is capable of pressing the disengaging piece 19 toward the axial side, is added thereto so as to constitute a disengaging mechanism 80.

According to the connector 61 having a shielding member constructed as described above, when the engagement between the male and female connectors 63 and 2 is canceled, it suffices if the male connector 63 is pulled apart from the female connector 2 while pressing the second unlocking portion 79 and holding a rear end portion of a male housing 68. In this case, since the frictional force due to the inclined surface 13*a* of the pressing wall 13 is not present, the pulling-apart force can be smaller. In addition, since the sliding member 11 becomes unnecessary, the number of parts used can be reduced. Hence, the efficiency in the disengaging operation can be improved further, and a cost reduction can be attained.

It should be noted that the connector having a shielding member in the present invention is not limited to the above-described embodiments, and may be implemented in other forms by making appropriate modifications. For example, although in the above-described embodiments the resilient piece 9 having the engaging projection 10 and the resilient piece 14 having the contact 15 are arranged at mutually opposing positions, a pair of resilient pieces 9 may be provided at mutually opposing positions, and the resilient piece 14 may be disposed at a position different from that in the above-described embodiments.

What is claimed is:

1. A connector having a shielding member including a male connector and a female connector which arc respectively connected to shielded wires, and respectively provided with a female-type terminal and a male-type terminal, a shielding member being provided on at least one of said male and female connectors, comprising:

a disengaging mechanism in which a groove portion is provided on an inner side of a female connector-side metal shell shieldingly connected to the shielded wire of said female connector, a resilient piece serving as a shielding member extending to an outside rearwardly from a front end portion of a male housing for holding the male-type terminal is provided in said shielding member shieldingly connected to the shielded wire of said male connector, and said resilient piece has an engaging projection for engaging in said groove portion, said disengaging mechanism cancels a state of engagement of said engaging projection in said groove portion as said engaging projection is moved toward an axial side, wherein said disengaging mechanism has a sliding member provided on an outer periphery of said male housing and operable to slide in an axial direction, and pressing wall disposed at a rear portion of said sliding member so as to press a disengaging piece toward the axial side, wherein said groove portion is circularly provided on said inner side of said female connector-side metal shell, and wherein said male connector can be inserted into said female connector-side metal shell in any rotation angle with respect to said female-connector-side metal shell.

2. A connector having a shielding member including a male connector and a female connector which are respectively connected to shielded wires, and respectively provided with a female-type terminal and a male-type terminal, a shielding member being provided on at least one of said male and female connectors, comprising:

a disengaging mechanism in which a groove portion is provided on an inner side of a female connector-side metal shell shieldingly connected to the shielded wire of said female connector, a resilient piece serving as a shielding member extending to an outside rearwardly from a front end portion of a male housing for holding the male-type terminal is provided in said shielding member shieldingly connected to the shielded wire of said male connector, and said resilient piece has an engaging projection for engaging in said groove portion, said disengaging mechanism cancels a state of engagement of said engaging projection in said groove portion as said engaging projection is moved toward an axial side, wherein said disengaging mechanism has a sliding member provided on an outer periphery of said male housing and operable to slide in an axial direction, and pressing wall disposed at a rear portion of said sliding member so as to press a disengaging piece toward the axial side, and said disengaging mechanism is arranged so that, in addition to said pressing wall, a flexible unlocking portion, which covers said disengaging piece and is operable to press said disengaging piece toward the axial side, is provided in a rear end portion of said sliding member.

3. A connector having a shielding member including a male connector and a female connector which are respectively connected to shielded wires, and respectively provided with a female-type terminal and a male-type terminal, a shielding member being provided on at least one of said male and female connectors, comprising:

a disengaging mechanism in which a groove portion is provided on an inner side of a female connector-side metal shell shieldingly connected to the shielded wire of said female connector, a resilient piece serving as a shielding member extending to an outside rearwardly from a front end portion of a male housing for holding the male-type terminal is provided in said shielding member shieldingly connected to the shielded wire of said male connector, and said resilient piece has an engaging projection for engaging in the groove portion, said disengaging mechanism cancels a state of engagement of said engaging projection in the groove portion as said engaging projection is moved toward an axial side, wherein said disengaging mechanism is arranged so that said engaging projection at an intermediate portion of said resilient piece and a disengaging piece at a rear end portion extending therefrom are provided in a continuous manner, and a flexible unlocking portion, which covers said disengaging piece and is operable to press said disengaging piece toward the axial side, is provided at a rear end portion of said male housing.

4. A connector having a shielding member including a male connector and a female connector which are respectively connected to shielded wires, and respectively provided with a female-type terminal and a male-type terminal, a shielding member being provided on at least one of said male and female connectors, comprising:

a disengaging mechanism in which a groove portion is provided on an inner side of a female connector-side metal shell shieldingly connected to the shielded wire of said female connector, a resilient piece serving as a shielding member extending to an outside rearwardly from a front end portion of a male housing for holding the male-type terminal is provided in said shielding member shieldingly connected to the shielded wire of said male connector, and said resilient piece has an engaging projection for engaging in said groove portion, said disengaging mechanism cancels a state of engagement of said engaging projection in said groove portion as said engaging projection is moved toward an axial side, wherein said disengaging mechanism has a sliding member provided on an outer periphery of said male housing and operable to slide in an axial direction, and pressing wall disposed at a rear portion of said sliding member so as to press a disengaging piece toward the axial side, and wherein said engaging projection is electrically connected with said inner wall of said female connector-side metal shell.

* * * * *